United States Patent [19]

Hsieh et al.

[11] Patent Number: 4,486,301

[45] Date of Patent: Dec. 4, 1984

[54] METHOD OF BENEFICIATING HIGH CARBONATE PHOSPHATE ORE

[75] Inventors: Shuang-shii Hsieh; James R. Lehr, both of Florence, Ala.

[73] Assignee: Tennessee Valley Authority, Muscle Shoals, Ala.

[21] Appl. No.: 571,320

[22] Filed: Jan. 16, 1984

Related U.S. Application Data

[63] Continuation of Ser. No. 525,073, Aug. 22, 1983, now Defensive Publication No. T104,304.

[51] Int. Cl.[3] ..... B03D 1/14

[52] U.S. Cl. ..... 209/167; 209/166; 252/61

[58] Field of Search ..... 209/166, 167; 252/61

[56] References Cited

U.S. PATENT DOCUMENTS

| | | | |
|---|---|---|---|
| 4,287,053 | 9/1981 | Lehr et al. | 209/167 |
| 4,317,715 | 3/1982 | Hintikka et al. | 209/166 |
| 4,362,615 | 12/1982 | Llewellyn et al. | 209/166 |

*Primary Examiner*—Bernard Nozick

*Attorney, Agent, or Firm*—Robert A. Petrusek

[57] ABSTRACT

A phosphate ore flotation process subjecting a phosphate ore containing carbonate mineral impurities to froth flotation in the presence of modifying agents, said modifying agents being alkyl phosphonic acids and hydrofluoric acid, and a collector, said collector being fatty acids; collecting the phosphate and carbonate minerals as rougher concentrate from the overflow; subjecting the phosphate and carbonate mineral concentrate to a differential desorption with an acid to remove the fatty acid from the surface of the phosphate mineral; removing the separated carbonate minerals from the overflow; and recovering the phosphate values in the underflow.

5 Claims, No Drawings

METHOD OF BENEFICIATING HIGH CARBONATE PHOSPHATE ORE

The invention herein described may be manufactured and used by or for the Government for governmental purposes without the payment to us of any royalty therefor.

This application is a continuation of application Ser. No. 525,073, filed Aug. 22, 1983 now Defensive Publication No. T104304, for Method of Beneficiating High Carbonate Phosphate Ore.

The present invention relates to a phosphate ore beneficiation process, and more particularly, the present invention relates to the use of alkyl phosphoric acids, hydrofluoric acid, and fatty acids to float both phosphate and carbonate minerals in the rougher flotation circuit, and to the use of strong acids as a differential desorption agent in the cleaner circuit to concentrate phosphate minerals as sink.

Current beneficiation practices for phosphate ores commonly utilize flotation as the principal step for separating phosphates from gangue minerals. The "Crago" or "double float" froth flotation process is commercially used for beneficiating such phosphate ores in which silica and silicate minerals are the predominant constituents of gangues. That process consists of conditioning the material with fatty acids and fuel oil, flotation of phosphate minerals, deoiling with sulfuric acid to remove the reagents, and refloating with amine reagents to remove the siliceous gangue which either floated or was trapped in the rougher float.

However, many phosphate ores of potential commercial value contain carbonate gangue mineral matter in addition to siliceous minerals. These carbonate mineral impurities include dolomite, calcite, dolomitic limestone, seashell and other less common carbonate-type minerals. Such mineral impurities not only dilute the $P_2O_5$ content of the phosphate ore concentrate, but also may interfere in subsequent chemical processing. For example, carbonate minerals present in phosphate ore concentrates used to produce phosphoric acid, superphosphate, or triple superphosphate consume sulfuric acid in the acidulation steps without providing additional fertilizer values. They aggravate foam formation in the reactor vessel. The presence of dolomite or dolomitic limestone in the phosphate ore concentrate is particularly important because relatively small amounts of magnesium (i.e. $>1$ percent MgO) may cause technical problems in current wet-process acid chemical plants due to increased viscosity of acid, increased defoamer usage, scale and sludge formation, and possibly difficulty in maintaining a standard diammonium phosphate (DAP) fertilizer grade.

The "double float" process has generally been ineffective for beneficiating such high carbonate phosphate ores. Collectors such as fatty acids used for phosphate minerals generally float carbonate minerals as well, and it is only by the employment of suitable selective depressants of either phosphate or carbonate gangue that adequate selectivity can be obtained.

Methods of beneficiating phosphate ores containing carbonate and siliceous gangue materials are described in the following U.S. Pat. Nos.: 3,259,242, Snow, July 1966; 3,462,016, Bushell et al, August 1969; 3,462,017, Bushell et al, August 1969; 3,807,556, Johnston, May 1974; 4,144,969, Snow, March 1979; 4,189,103, Lawver et al, February 1980; 4,287,053, Lehr et al, September 1981; 4,317,715, Hintikka et al, March 1982; 4,364,824, Snow, Dec. 21, 1982; and 4,372,843, Lawver et al, February 1983. Each of these patents deals with processes that differ from the present invention.

Snow, in U.S. Pat. No. 3,259,242 supra, for example, describes the beneficiation of a macro-crystalline apatite-calcite mixture which utilizes a cationic flotation to collect apatite as a float concentrate. Bushell et al, in U.S. Pat. No. 3,462,016 supra, teach the use of $H_3PO_4$ and Bushell et al in U.S. Pat. No. 3,462,017 supra teach the use of $NH_4H_2PO_4$, both as phosphate mineral depressants, for beneficiating carbonate-bearing phosphate rock. Johnston in U.S. Pat. No. 3,807,556 supra further teaches the use of soluble sulfate salts such as $Na_2SO_4$ or $(NH_4)_2SO_4$ to reduce the loss of soluble phosphate in the processes of U.S. Pat. Nos. 3,462,016 and 3,462,017, supra.

The use of an apatite-collecting cationic reagent and a liquid hydrocarbon is described in U.S. Pat. No. 4,144,969 and 4,189,103, supra. These patents describe a phosphate ore beneficiating process in which the deslimed ore is first subjected to a "double float" froth flotation as described in U.S. Pat. No. 2,293,640, Crago, Aug. 18, 1942, to remove siliceous gangue. The float product containing apatite with dolomite impurities is then conditioned with a cationic agent and a liquid hydrocarbon to concentrate apatite as float.

Hintikka et al, in U.S. Pat. No. 4,317,715 supra, describe two alternative processes to separate phosphate minerals from carbonate minerals after phosphate and carbonate minerals are concentrated from silicates; (1) the combined phosphate-carbonate concentrate is treated with a base, whereafter phosphate mineral is floated with a cationic collector, or (2) the combined phosphate-carbonate concentrate is treated with $SO_2$ or $CO_2$ to recover phosphate as a float.

Recently issued U.S. Pat. Nos. 4,364,824 and 2,372,843, supra, describe a flotation process for removing carbonate mineral impurities. The process employs salts of sulfonated linear fatty acids as a carbonate mineral collector and a phosphate depressant, such as polyphosphate, metaphosphate, pyrophosphate or orthophosphate, to remove carbonate minerals in the overflow and to collect the phosphate concentrate in the underflow.

Lehr et al, in U.S. Pat. No. 4,287,053, assigned to the assignee of the present invention, describe a phosphate ore beneficiating process in which phosphate ores containing carbonate mineral impurities are subjected to froth flotation in the presence of phosphate depressants, said depressants comprising alkyl diphosphonic acids, and a carbonate collector, said collector comprising fatty acids, removing the separated carbonate minerals from the overflow, and recovering the phosphate value in the underflow. This method of Lehr's works well when dolomite is the major carbonate mineral; however, their method is frought with difficulties when applied to some highly calcitic types of phosphate ore.

The present invention provides an effective froth flotation process for beneficiating phosphate ore containing carbonate mineral impurities of the calcite or dolomite variety, or a combination of both. The froth flotation consists of two main flotation circuits. In the first main flotation circuit (or rougher flotation circuit), the froth flotation is performed in the presence of two modifying agents, said modifying agents being alkyl diphosphonic acids and hydrofluoric acid, and in the presence of a high dosage of the mineral collector, said collector being a fatty acid type reagent, collecting both phosphate and carbonate minerals from the overflow, and removing silica and silicate wastes from the underflow. Additional silica and silicates can be further removed by cleaning the rougher concentrate with conventional methods known in the art without addition of reagents. In the second main flotation circuit (or carbonate flotation circuit), a strong acid, preferably $H_2SO_4$, is used as a differential desorption agent to selectively remove fatty acid coating from the disphosphonic acid-treated phosphate mineral surface, and thereafter to remove by froth flotation carbonate mineral impurities as the overflow fraction and recovering phosphate values in the underflow sinks.

One preferred class of diphosphonic acid used as a modifying agent in the rougher flotation circuit is hydroxylethylidene diphosphonic acid, which consists of one hydroxyl group and one methyl group attached to the bridge carbon of the ($O_3P$-C-$PO_3$) group. U.S. Pat. No. 4,287,053, supra, teaches that the diphosphonic acid is preferentially and firmly adsorbed or bonded on the phosphate mineral surface and that the short hydrocarbon chain (methyl group) and hydroxyl group of diphosphonic acid made phosphate mineral surface less hydrophobic and hence less floatable. During the experimental work leading to the present invention, it was found in practicing the teachings of Lehr et al U.S. Pat. No. 4,287,053 supra, that the diphosphonic acid may also be adsorbed on the calcitic-type carbonate mineral surface to such an extent that separation of phosphate and carbonate minerals becomes difficult. However, it was found that the pretreatment application of diphosphonic acid in the rougher flotation circuit enhances the effectiveness of separating carbonate minerals from phosphate minerals in the subsequent carbonate flotation circuit, provided a strong acid is used as a differential desorption agent to remove fatty acid films from the phosphate mineral. In this treatment, however, the adsorption of diphosphonic acid on phosphate mineral surface is sufficiently strong to resist removal.

Another modifying agent used in the rougher float in the present invention was hydrofluoric acid. Hydrofluoric acid tends to increase the flotation of both phosphate and carbonate mineral in the rougher flotation step and to increase the effectiveness of separating these two types of minerals in the subsequent carbonate flotation (cleaner circuit) if an appropriate amount is used. An overdosage of hydrofluoric acid may decrease the flotation of phosphate minerals, probably as the result of high concentration of hydrogen ion, which reacts with carbonate and phosphate minerals.

The preferred strong mineral acid used as differential desorption' agent in the cleaner flotation circuit (carbonate flotation circuit) is sulfuric acid. This acid selectively removes the fatty acid coating of phosphate minerals during reconditioning, and the carbonate minerals are floated as the waste without further addition of collector. Phosphate minerals are finally recovered in the underflow.

Phosphate ores which are beneficiated by the method of this invention may naturally occur in discrete particles, or if not, may be comminuted and classified to desired size ranges by methods known in the art. A particle size smaller than about 28 mesh is preferably used for the flotation process. With larger particle size, an appreciable quantity of the gangue minerals may remain locked with the apatite. Furthermore, the larger ore particles are sometimes difficult to float. Very small particles, e.g., smaller than about 400 mesh, are removed by a desliming process. Although the slime may contain phosphate values, their relatively large consumption of reagents makes their beneficiation economically unattractive in relation to recoverable values of $P_2O_5$.

The practice of the present invention is demonstrated in one embodiment thereof by the results in flotation using a highly calcitic North Carolina phosphate matrix. The flotation feed was a minus 28-plus 400-mesh fraction, prepared by grinding and screening from the carbonate minerals bearing phosphate pebble. The feed was first conditioned with hydrofluoric acid and diphosphonic as modifying agents. Fatty acid, or fatty acid with fuel oil extender, was then added as a collector for both phosphate and carbonate minerals. The silica and silicate minerals were then removed from the underflow as wastes. Additional silica and silicates can be further removed by refloating the rougher concentrate of phosphate and carbonate minerals, if so desired. After the separation of phosphate and carbonate minerals from silica and silicates, the phosphate and carbonate minerals were reconditioned with a strong acid used as a differential desorption agent to remove fatty acid from the phosphate mineral surface. The carbonate minerals were then floated and removed in the overflow of the cleaner circuit without further addition of fatty acid collector. The phosphate minerals were finally collected from underflow.

The present invention is further illustrated by the following examples. In order that those skilled in the art may better understand how the present invention can be practiced, the following examples are given by way of illustration and not necessarily by way of limitation.

EXAMPLE I

A North Carolina phosphate ore containing carbonate minerals was used in this example. The pebble fraction which contained undesirable carbonate minerals was stage-ground in a rod mill to prepare a −28 mesh +400 mesh flotation feed. This feed contained about 44.5 percent CaO, 23.1 percent $P_2O_5$, 0.71 percent MgO, and 12.3 percent $SiO_2$. The $CaO/P_2O_5$ ratio was 1.93. A 500-gram flotation feed was introduced into the Denver (Model No. D-12) laboratory conditioning equipment, and the pulp density was adjusted to about 65 percent solids (by weight) by the addition of water. The flotation feed was conditioned in three stages, to wit: (1) one minute with 1 kg of hydrofluoric acid per ton of feed, (2) subsequently the feed was conditioned for one minute with 0.05 kg of hydroxylethylidene diphosphonic acid (Monsanto's Dequest 2010, or equivalent) per ton of feed, and (3) the feed was conditioned for 2.5 minutes at the ratio of 3 kg of isostearic acid (Union Camp's Century 1105, or equivalent) per ton. The impeller speed for conditioning was 600 rpm. The pH of the conditioning slurry was 6.2 at the end of conditioning. After conditioning, the pulp was transferred to a Denver 500-gram flotation cell and diluted with sufficient tap water to float the pulp and collect phosphate and carbonate minerals. The silica and silicates remained in the sink as wastes (rougher sink in Table I, infra). The phosphate and carbonate minerals concentrate was returned to the flotation cell, diluted with tap water and refloated once to remove additional silica and silicates as sink (first cleaner sink in table I, infra). The refloated phosphate and carbonate minerals concentrate was returned to the flotation cell and diluted with tap water. The pulp was then added with 7 kg of sulfuric acid per ton of feed and conditioned for 2.5 minutes. The pH at the end of conditioning was 5.3. The carbonate mineral impurities were then removed as float (second cleaner float). The phosphate concentrate was finally collected as sink (second cleaner sink). The float and sink samples were filtered, ovendried, and analyzed. The results are shown in Table I below.

TABLE I

Flotation Results with 1 kg of HF, 0.05 kg of Hydroxylethylidene Diphosphonic Acid, 3 kg of Isostearic Acid, and 7 kg of $H_2SO_4$ per Ton of Feed

| Product | Wt % | Analyses, wt % CaO | $P_2O_5$ | MgO | $SiO_2$ |
|---|---|---|---|---|---|
| Rougher sink | 6.4 | 1.3 | 0.6 | 0.04 | 95.8 |
| 1st Cleaner sink | 1.0 | 11.9 | 6.5 | 0.30 | 74.3 |
| 2nd Cleaner sink | 75.0 | 46.2 | 29.0 | 0.7 | 6.6 |
| 2nd Cleaner float | 17.6 | 51.5 | 10.8 | 1.0 | 1.0 |
| Head | 100.0 | 44.4 | 23.7 | 0.7 | 12.0 |

| | Distribution, wt % CaO | $P_2O_5$ | MgO | $SiO_2$ | $CaO/P_2O_5$ |
|---|---|---|---|---|---|
| Rougher sink | 0.2 | 0.2 | 0.4 | 51.2 | 2.2 |
| 1st Cleaner sink | 0.3 | 0.3 | 0.4 | 6.2 | 1.83 |
| 2nd Cleaner sink | 78.8 | 91.5 | 74.3 | 41.1 | 1.59 |
| 2nd Cleaner float | 20.7 | 8.0 | 24.9 | 1.5 | 4.77 |
| Head | 100.0 | 100.0 | 100.0 | 100.0 | 1.85 |

EXAMPLE II

The phosphate ore flotation was performed as outlined in Example I, supra, except that the dosage of sulfuric acid was increased from 7 kg per ton to 9.0 kg. per ton to feed in the carbonate minerals flotation circuit. The pH at the end of conditioning the carbonate flotation circuit was 5.2. The flotation results are shown in Table II below. These results are similar to those in Example I, supra.

TABLE II

Flotation Results as $H_2SO_4$ Increased to 9 kg per Ton of Feed

| Product | Wt % | Analyses, wt % CaO | $P_2O_5$ | MgO | $SiO_2$ |
|---|---|---|---|---|---|
| Rougher sink | 6.3 | 1.0 | 0.5 | 0.1 | 98.5 |
| 1st Cleaner sink | 1.0 | 10.1 | 5.6 | 0.2 | 78.1 |
| 2nd Cleaner sink | 79.2 | 46.8 | 28.4 | 0.7 | 7.1 |
| 2nd Cleaner float | 13.5 | 52.4 | 6.5 | 1.2 | 0.5 |
| Head | 100.0 | 44.3 | 23.5 | 1.7 | 12.6 |

| | Distribution, wt % CaO | $P_2O_5$ | MgO | $SiO_2$ | $CaO/P_2O_5$ |
|---|---|---|---|---|---|
| Rougher sink | 0.1 | 0.1 | 0.9 | 48.9 | 2.0 |
| 1st Cleaner sink | 0.2 | 0.2 | 0.3 | 6.1 | 1.80 |
| 2nd Cleaner sink | 83.7 | 95.9 | 76.8 | 44.5 | 1.65 |
| 2nd Cleaner float | 16.0 | 3.8 | 22.0 | 0.5 | 8.06 |
| Head | 100.0 | 100.0 | 100.0 | 100.0 | 1.89 |

EXAMPLE III

The phosphate ore flotation was performed as outlined in Example I, supra, except that hydrofluoric acid was used as a substitute for sulfuric acid in the carbonate minerals flotation circuit. The dosage of hydrofluoric acid used in this example was 4.5 kg per ton of feed. The pH at the end of conditioning of the carbonate flotation circuit was 4.8. The flotation results are shown in Table III below.

TABLE III

Flotation Results Using 4.5 kg of HF As Desorption Agent

| Product | Wt. % | Analyses, Wt % CaO | $P_2O_5$ | MgO | $SiO_2$ |
|---|---|---|---|---|---|
| Rougher sink | 10.2 | 15.6 | 9.2 | 0.2 | 71.4 |
| 1st Cleaner sink | 0.9 | 21.6 | 11.3 | 0.3 | 58.5 |
| 2nd Cleaner sink | 63.2 | 47.9 | 28.0 | 0.7 | 6.6 |
| 2nd Cleaner float | 25.7 | 51.5 | 19.2 | 0.8 | 11.9 |
| Head | 100.0 | 45.3 | 23.7 | 0.7 | 12.5 |

| | Distribution, Wt % CaO | $P_2O_5$ | MgO | $SiO_2$ | $CaO/P_2O_5$ |
|---|---|---|---|---|---|
| Rougher sink | 3.5 | 4.0 | 3.1 | 58.6 | 1.70 |
| 1st Cleaner sink | 0.4 | 0.4 | 0.4 | 4.1 | 1.91 |
| 2nd Cleaner sink | 66.9 | 74.8 | 66.0 | 33.4 | 1.71 |
| 2nd Cleaner float | 29.2 | 20.8 | 30.5 | 3.9 | 2.68 |
| Head | 100.0 | 100.0 | 100.0 | 100.0 | 1.91 |

The phosphate ore flotation was performed as outlined in Example I, supra, except that a different fatty acid, namely a mixture of isostearic and isooleic branched-chain fatty acids (Union Camp's Century MO5, or equivalent) and No. 2 fuel oil were used to substitute for isostearic acid in the rougher flotation circuit. The dosage of both the fatty acid and the fuel oil was 2 kg per ton of feed and the conditioning time was 5 minutes. The pH at the end of conditioning of rougher flotation circuit was 6.6. In the carbonate minerals flotation circuit, the dosage of sulfuric acid was 5 kg per ton of feed and the pH at the end of conditioning was 5.5. The flotation results are shown in Table IV below.

TABLE IV

Flotation Results with a Mixture of Isostearic and Isooleic Branched-Chain Fatty Acids and Fuel Oil as Collector

| Product | Wt % | Analyses, wt % CaO | $P_2O_5$ | MgO | $SiO_2$ |
|---|---|---|---|---|---|
| Rougher sink | 6.4 | 1.6 | 0.8 | 0.07 | 98.4 |
| 1st Cleaner sink | 1.0 | 8.3 | 4.8 | 0.2 | 81.7 |
| 2nd Cleaner sink | 72.0 | 46.2 | 28.3 | 0.7 | 7.1 |
| 2nd Cleaner sink | 20.6 | 52.2 | 10.8 | 0.9 | 0.8 |
| Head | 100.0 | 45.3 | 23.7 | 0.7 | 12.5 |

| Product | Distribution, wt % CaO | $P_2O_5$ | MgO | $SiO_2$ | $CaO/P_2O_5$ |
|---|---|---|---|---|---|
| Rougher sink | 0.2 | 0.2 | 0.6 | 50.7 | 2.0 |
| 1st Cleaner sink | 0.2 | 0.2 | 0.3 | 6.7 | 1.73 |
| 2nd Cleaner sink | 75.4 | 89.8 | 72.4 | 41.3 | 1.63 |
| 2nd Cleaner float | 24.2 | 9.8 | 26.7 | 1.3 | 4.83 |
| Head | 100.0 | 100.0 | 100.0 | 100.0 | 1.91 |

The results of the above four examples illustrate that the highly calcitic carbonate phosphate rocks can be effectively beneficiated by the processes of the present invention of froth flotation process, said flotation process being performed in the presence of alkyl phosphonic acid and hydrofluoric acid as the modifying agents and in the presence of fatty acid or the mixture of fatty acid and fuel oil collector, to collect phosphate and carbonate minerals in the rougher float, is further treated with an acid to differentially remove fatty acid from the phosphate mineral surface, and refloat carbonate minerals as the waste and collect phosphate mineral concentrate from the underflow. Further reduction of silica and silicate minerals can be obtained either before or after the carbonate flotation with conventional methods known in the art as, for example, with amines. In our examples, reductions of silica and silicate contents were made before the carbonate flotation.

After sifting and winnowing through the data supra, as well as other results of tests, the operating and preferred parameters and variables for flotation separation of the present invention are shown in the following tabulation:

| | Operating range | Preferred range |
|---|---|---|
| Feed size | −16 mesh + 10 micron | −28 mesh + 400 mesh |
| Pulp density (solid) | 20–74% | 60–70% |
| Reagents (kg/ton) | | |
| Fatty acid | 0.5–4.0 | 1.0–3.0 |
| Fuel oil | 0–4.0 | 0–3.0 |
| Diphosphonic acid | 0.01–0.5 | 0.05–0.3 |
| HF | 0.05–2.0 | 0.1–1.0 |
| $H_2SO_4$ | 1.5–8.0 | 2.0–7.0 |
| Conditioning time (minutes) | | |
| Modifiers | 0.5–5 | 1–2 |
| Collector | 1–10 | 2.5–5 |
| Conditioning pH (rougher) | 5–8 | 6–7 |
| Desorption time (minutes) | 1–10 | 2–4 |

While we have shown and described particular embodiments of our invention, modifications and variations thereof will occur to those skilled in the art. We wish it to be understood, therefore, that the appended claims are intended to cover such modifications and variations which are within the true scope and spirit of our invention.

What we claim as new and desire to secure by Letters Patent of the United States is:

1. An ore flotation process which comprises the steps of (1) subjecting a phosphate ore containing carbonate mineral impurities to froth flotation in the presence of modifying agents, said modifying agents being alkyl phosphonic acid and hydrofluoric acid, and a collector, said collector being a fatty acid;

(2) collecting the phosphate and carbonate minerals as rougher concentrate from the overflow;

(3) subjecting the phosphate and carbonate mineral concentrate to a differential desorption with an acid to remove fatty acid from the surface of phosphate mineral;

(4) removing the separated carbonate minerals from the overflow; and (5) recovering the phosphate values in the underflow.

2. The process of claim 1 wherein said alkyl phosphonic acids are alkyl diphosphonic acids.

3. The process of claim 1 wherein said alkyl phosphonic acid is hydroxylethylidene disphosphonic acid.

4. The process of claim 1 in which said fatty acids are employed as acid or as soap derivatives.

5. The process of claim 1 in which said fatty acids are employed in conjunction with fuel oil as an extender.

* * * * *